United States Patent [19]

Grenn et al.

[11] Patent Number: 4,768,480

[45] Date of Patent: Sep. 6, 1988

[54] ENGINE WITH SPARK IGNITION OPERATION THROUGH THE OIL PRESSURE SWITCH AFTER FUEL SHUTOFF

[75] Inventors: Daniel P. Grenn, Milford; Gary J. Wallo, Union Lake, both of Mich.

[73] Assignee: General Motors Corporation, Detroit, Mich.

[21] Appl. No.: 130,935

[22] Filed: Dec. 10, 1987

[51] Int. Cl.[4] ..... F02B 77/00

[52] U.S. Cl. ..... 123/198 D; 123/198 DB; 123/198 DC

[58] Field of Search .... 123/198 D, 198 DB, 198 DC, 123/198 C, DIG. 11; 60/900

[56] References Cited

U.S. PATENT DOCUMENTS

| | | | |
|---|---|---|---|
| 3,241,539 | 3/1966 | Kuehn, III | 123/198 DC |
| 3,482,562 | 12/1969 | Ranft | 123/198 DC |
| 3,741,188 | 6/1973 | Rickey | 123/198 DB |
| 3,867,919 | 2/1975 | Grenier et al. | 123/198 D |
| 4,312,310 | 1/1982 | Chivilo et al. | 123/198 D |
| 4,470,397 | 9/1984 | Brotharson | 123/198 D |
| 4,656,973 | 4/1987 | Endres | 123/198 D |

*Primary Examiner*—Raymond A. Nelli

*Attorney, Agent, or Firm*—Robert M. Sigler

[57] ABSTRACT

A motor vehicle engine includes an operator controlled fuel injection enabling switch effective to disconnect electric fuel injection apparatus from an electric power source and thus initiate the cessation of engine operation when deactivated. However, the spark ignition system is still powered through an oil pressure switch so as to continue engine operation for a few extra crankshaft rotations to reduce the unburned fuel in the intake passage as the engine stops and thus reduce throttle bore coking. In a vehicle having a fuel pump relay activated by the fuel injection enabling switch with contacts connected across the oil pressure switch, the invention may be obtained by changing the power connection of the spark ignition system from the fuel injection enabling (ignition) switch to the fuel pump relay.

4 Claims, 1 Drawing Sheet

ENGINE WITH SPARK IGNITION OPERATION THROUGH THE OIL PRESSURE SWITCH AFTER FUEL SHUTOFF

BACKGROUND OF THE INVENTION

This invention relates to the reduction of throttle bore coking in fuel injected motor vehicle engines. Throttle bore coking is a buildup of carbon and possibly other substances on the throttle plate and throttle bore of an engine which can occur on engines provided with port fuel injection: that is, in which the fuel is injected below the throttle bore adjacent the individual combustion chamber inlet valves, so that the throttle bore is not washed with fuel as in throttle body injected engines.

Throttle bore coking can, over time, result in the narrowing of the air passage past a throttle valve which is only slightly open for idle and a resulting lower idle speed. The carbon buildup can be cleaned out during regular engine maintenance by spraying an appropriate cleaner down the throttle bore. Between such cleanings, many idle speed controls can compensate, under normal circumstances, for the narrowing by sensing idle speed and opening the throttle to compensate. However, the degree of throttle opening may not be sufficient for easy cold starts in very cold climates. Additional air passages and/or a hole in the throttle plate may provide additional idle air flow capacity which may be less affected by coking. However, the invention disclosed and claimed herein is an alternative to these measures suitable for many vehicles which does not require expensive design changes to the throttle body or throttle valve.

SUMMARY OF THE INVENTION

The invention is a motor vehicle engine in which the operator initiates the cessation of engine operation by deactivating fuel delivery by the fuel injection apparatus; but the spark ignition apparatus is operated for a few additional engine revolutions to clear out the extra fuel from the intake passages and burn it in the combustion chambers before the engine actually stops.

In particular, the invention comprises a motor vehicle engine comprising a combustion chamber, an air intake passage defining a throttle bore with a throttle valve therein for controlling the flow of combustion air to the combustion chamber, electric powered fuel injection means effective, when activated, to supply fuel to the combustion chamber in proper quantity and timing for combustion with the combustion air, a spark ignition system effective to initiate combustion of the fuel and air in the combustion chamber, an oil lubrication system including an oil pump powered by the engine while the engine operates, an electric power source, an operator controlled fuel injection enabling switch effective to connect the electric powered fuel injection means to the electric power source only when activated and therefore effective to initiate the cessation of engine operation when deactivated, an oil pressure switch closed when the pressure generated by the oil pump exceeds a predetermined value indicative of engine operation, and circuit means effective to provide electric power from the electric power source to the spark ignition system when the fuel injection enabling switch is activated and to continue to provide said power through the oil pressure switch when the fuel injection enabling switch is deactivated until the oil pressure switch opens.

The apparatus operates advantageously to remove unburned fuel from the engine intake apparatus when the engine is stopped. Thus, the fuel is not carried back up into the throttle bore to be deposited and leave a carbon residue on the throttle bore and plate. In addition, the invention may help reduce the incidence of spark plug fouling, in throttle body injected engines as well as port injected engines, since the fuel drawn into the combustion chambers is burned by the continuing spark ignition during the additional engine revolutions.

The circuit means effective to power the spark ignition means may be a relay having contacts in parallel with the oil pressure switch and an activating coil connected to the ignition switch, with the spark ignition system connected to the oil pressure switch and one of the relay contacts to be powered through either the oil pressure switch or relay. The invention is particularly suited to vehicles already having such a relay in the form of a fuel pump relay powering an electric motor fuel pump and having the oil pressure switch across the contacts as a backup for the relay. In such vehicles, the invention may generally be obtained by the changing of the electric power supply for the spark ignition system from the ignition switch to the junction of the oil pressure switch and fuel pump.

DESCRIPTION OF THE PREFERRED EMBODIMENT

Figure 2:
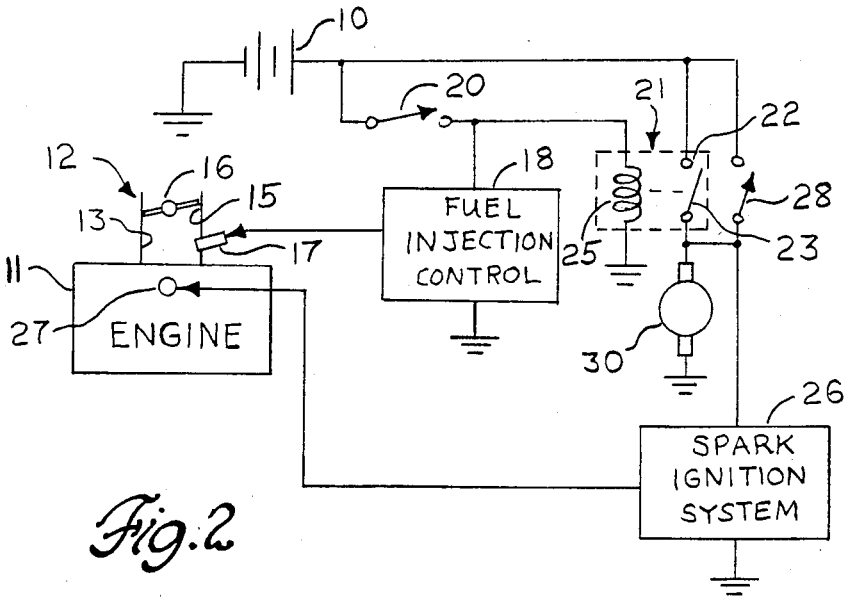
FIG. 2 shows a schematic and circuit diagram of an engine apparatus according to this invention.

Referring to FIG. 2, a motor vehicle is provided with a standard electric power source, symbolized by battery 10. It is understood that the electric power source may also include a standard alternator, voltage regulator, fuses, etc. An engine 11 includes at least one internal combustion chamber, which is not specifically shown in FIG. 2 but is standard with intake and exhaust valves, piston, etc. A throttle body 12 defines an air intake passage 13 with a throttle bore 15 with a throttle plate 16 rotatable therein to control the flow of intake air therethrough to the combustion chamber of engine 11. Throttle plate 15 may have standard idle control means, not shown, in which a stepper motor or other positioning means is controllable to position an idle stop and thus define a "closed throttle" which is actually slightly open to allow idle air flow to engine 11. This opening may be supplemented by an additional idle air passage past throttle plate 16 without departing from the invention. Such features are well known in the art.

A fuel injector 17 is positioned to inject fuel into intake passage 13, in this port injection embodiment, below throttle bore 15, in response to an electric fuel injection control 18. In practice, the intake passage will include an intake manifold with multiple passages leading from throttle bore 15 to the individual combustion chamber intake valves; and there will be a separate fuel injector 17 near each such intake valve. However, the invention may be applied to throttle body injection, in which fuel injector 17 is positioned above throttle plate 16, high pressure fuel injection systems in which injector 17 injects directly into the combustion chamber, or any other fuel injection system in which the fuel injectors are electrically controlled.

Fuel injection control 18 may be any typical electric fuel injection control which provides injection signals at appropriate times for the injection of fuel into the intake passage in proper amount for combustion with the intake air and will generally include additional sensors, not shown, for air flow (or pressure), temperature, crankshaft position, etc. Fuel injection control 18 is powered from battery 10 through a fuel injection enabling switch 20, which is controllable by the vehicle operator to enable or disable engine operation. Switch 20 may be the standard vehicle "ignition switch", although in this invention it does not directly control ignition.

A relay 21 has contacts comprising a normally open contact 22 and an armature 23 effective to contact normally open contact 22 when activated by an activating coil 25. Activating coil 25 is connected in series with the fuel injection activating switch 20 and battery 10 so as to conduct when switch 20 is closed or activated.

Engine 11 is provided with a spark ignition system 26 which provides suitable spark firing pulses to a spark plug 27 located in the combustion chamber of engine 11 and effective, when it receives such pulses, to initiate combustion of the fuel and air provided to the combustion chamber. Spark ignition system 26 is connected in series with the contacts 22, 23 of relay 21 and battery 10, so that it will be powered through relay 21 whenever fuel injection activating switch 20 is closed. However, engine 11 is also provided with an oil pressure switch 28 connected across relay contacts 22, 23 and thus connecting, when closed, spark ignition system 26 in series with battery 10. Oil pressure switch 28 is responsive to the oil pressure in a an oil lubrication system of engine 11, the lubricating system including an oil pump mechanically powered by the engine while the engine operates: that is, while the engine crankshaft is rotating. Such a lubricating system with pump and oil pressure switch is well known and standard in engine design and is thus not shown in the Figure, except for switch 28.

Figure 1:
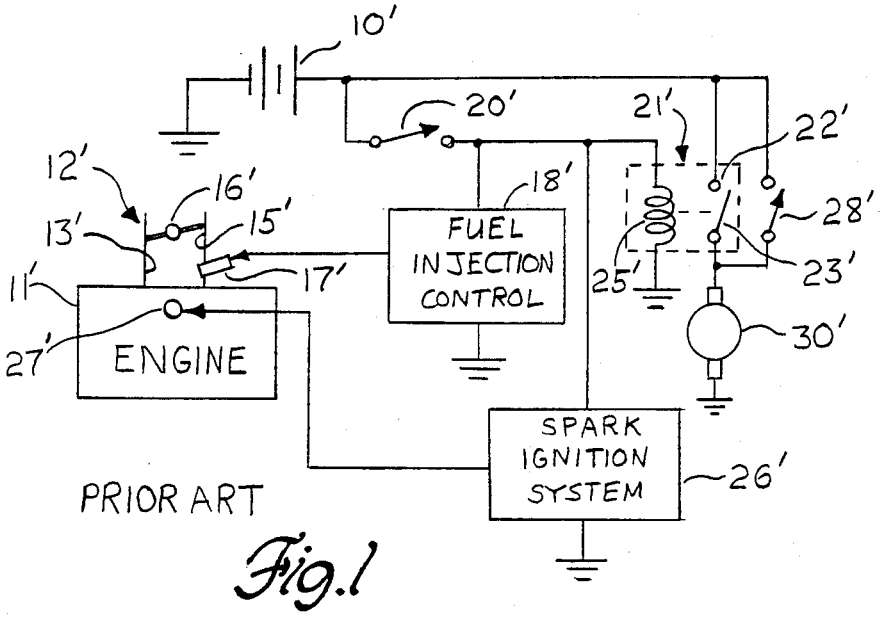
FIG. 1 shows a schematic and circuit diagram of a prior art engine apparatus.

An additional item in the embodiment shown is an electric motor driven fuel pump 30, which is also connected in series with the contacts 22, 23 of relay 21 and battery 10. This provides a comparison with the prior art engine of FIG. 1, in which the elements are identified by corresponding primed reference numbers. It can be seen that the only difference between the Figures is the electric power connection of the spark ignition system, which, in FIG. 1, is obtained from switch 20', switch 20' thus being a true ignition switch. In the engine of FIG. 1, the fuel injection control and spark ignition system are controlled simultaneously by switch 20 to both cease operation at the same time when switch 20 is opened by the operator to cease engine operation. Fuel pump 30' is also controlled by ignition switch 20' through a fuel pump relay 21'. Oil pressure switch 28' is included as a backup across the contacts 22', 23' of relay 21' so that the engine can still be operated in case of relay failure.

The arrangement of FIG. 1 may be changed to that of FIG. 2 by changing the power connection of the spark ignition system, although certain other engineering changes might have to be made to ensure the proper operation of all components in the new arrangement. In the operation of the embodiment of FIG. 2, the engine is enabled for operation by the closure of switch 20, which activates the fuel injection control and relay 21, relay 21 activating fuel pump 30 and spark ignition system 26. The engine is started by standard starting means not shown or further described. When switch 20 is opened to initiate the cessation of engine operation, fuel injection control 18 is deactivated so that no additional fuel is injected into intake passage 13. However, engine 11 is still operating on the fuel already within intake passage 13 and/or within the combustion chambers. Therefore the crankshaft is still powering the pump in the lubrication system to provide oil pressure and keep switch 28 closed. Spark ignition system 26 thus continues to fire spark plug 27 until the fuel in intake passage 13 and/or the combustion chamber is exhausted and the engine has an opportunity to slow its crankshaft rotation sufficiently for the oil pressure to drop and open switch 28. In tests on a particular engine, stopping the engine from an idle speed of about 600 RPM provided 3–6 extra spark firings per combustion chamber, whereas stopping from an engine speed of 1500–2000 RPM provided 10–15 extra spark firings per combustion chamber. The arrangement of the invention does not, however, increase the observable stopping time of the engine noticeably. In a test wherein an engine was made switchable between the arrangements of FIGS. 1 and 2, observers could not reliably identify which system was being used to stop the engine, even though they were aware of the purpose of the test and were thus looking for differences in stopping times. Further tests have substantiated that the apparatus of FIG. 2 significantly reduces the unburned hydrocarbons left within the intake passage as an engine is first stopped. The fuel that is thus not retained in the throttle bore is not available for coking.

The embodiments of the invention in which an exclusive property or privilege is claimed are defined as follows:

1. A motor vehicle engine comprising a combustion chamber, an air intake passage defining a throttle bore with a throttle valve therein for controlling the flow of combustion air to the combustion chamber, electric powered fuel injection means effective, when activated, to supply fuel to the combustion chamber in proper quantity and timing for combustion with the combustion air, a spark ignition system effective to initiate combustion of the fuel and air in the combustion chamber, an oil lubrication system including an oil pump powered by the engine while the engine operates, and further comprising, in combination:

an electric power source;

an operator controlled fuel injection enabling switch effective to connect the electric powered fuel injection means to the electric power source only when activated and therefore effective to initiate the cessation of engine operation when deactivated;

an oil pressure switch closed when the pressure generated by the oil pump exceeds a predetermined value indicative of engine operation; and circuit means effective to provide electric power from the electric power source to the spark ignition system when the fuel injection enabling switch is activated and to continue to provide said power through the oil pressure switch when the fuel injection enabling switch is deactivated until the oil pressure switch opens, whereby the intake passage is cleared of unburned fuel as the engine is stopped to reduce throttle bore coking.

2. A motor vehicle engine comprising a combustion chamber, an air intake passage defining a throttle bore with a throttle valve therein for controlling the flow of combustion air to the combustion chamber, electric powered fuel injection means effective, when activated, to supply fuel to the combustion chamber in proper quantity and timing for combustion with the combustion air, a spark ignition system effective to initiate combustion of the fuel and air in the combustion chamber, an oil lubrication system including an oil pump powered by the engine while the engine operates, and further comprising, in combination:

an electric power source;

an operator controlled fuel injection enabling switch effective to connect the electric powered fuel injection means to the electric power source only when activated and therefore effective to initiate the cessation of engine operation when deactivated;

a relay having an activating coil connected in series with the electric power source and fuel injection enabling switch and further having contacts closed by conduction of the activating coil;

an oil pressure switch closed when the pressure generated by the oil pump exceeds a predetermined value indicative of engine operation, the oil pressure switch being connected across the contacts of the relay in series with the electric power source; and circuit means connecting the spark ignition system in series with the electric power source and the oil pressure switch, whereby, when cessation of engine operation is initiated by the deactivation of the fuel injection enabling switch, the ignition system is activated for an additional period through the oil pressure switch to provide combustion for any fuel left in the intake passage to reduce throttle bore coking.

3. The motor vehicle engine of claim 2 in which the electric powered fuel injection means comprises an electric motor driven fuel pump connected in series with the electric power source through the contacts of the relay.

4. The motor vehicle engine of claim 2 in which the fuel injection enabling switch is the vehicle ignition switch.

* * * * *